US008015774B1

(12) United States Patent
Sorkin

(10) Patent No.: US 8,015,774 B1
(45) Date of Patent: Sep. 13, 2011

(54) PROCESS AND APPARATUS FOR FORMING A SHEATHING RETAINING ANCHOR

(76) Inventor: Felix L. Sorkin, Stafford, TX (US)

( * ) Notice: Subject to any disclaimer, the term of this patent is extended or adjusted under 35 U.S.C. 154(b) by 342 days.

(21) Appl. No.: 12/183,847

(22) Filed: Jul. 31, 2008

(51) Int. Cl.
*E04C 5/08* (2006.01)

(52) U.S. Cl. ..... 52/745.21; 52/223.13; 403/368; 403/374.1

(58) Field of Classification Search ..... 52/745.21, 52/223.13, 223.14, 223.6; 24/459; 403/371, 403/374.1, 282, 315, 373, 367, 368
See application file for complete search history.

(56) References Cited

U.S. PATENT DOCUMENTS

| | | | | | |
|---|---|---|---|---|---|
| 3,596,330 | A * | 8/1971 | Scott et al. | 24/122.3 |
| 3,668,612 | A * | 6/1972 | Nepovim | 439/584 |
| 3,833,706 | A * | 9/1974 | Edwards | 264/228 |
| 3,844,697 | A * | 10/1974 | Edwards | 425/111 |
| 3,937,607 | A * | 2/1976 | Rodormer | 425/111 |
| 4,084,067 | A * | 4/1978 | Gillemot | 174/92 |
| 4,561,226 | A * | 12/1985 | Tourneur | 52/223.13 |
| 4,633,540 | A * | 1/1987 | Jungwirth et al. | 14/22 |
| 4,640,479 | A * | 2/1987 | Shely et al. | 248/56 |
| 4,719,658 | A * | 1/1988 | Kriofske | 52/223.13 |
| 4,773,198 | A * | 9/1988 | Reinhardt | 52/223.13 |
| 5,630,301 | A * | 5/1997 | Sieg | 52/223.13 |
| 5,749,185 | A * | 5/1998 | Sorkin | 52/223.13 |
| 5,755,065 | A * | 5/1998 | Sorkin | 52/223.13 |
| 6,027,278 | A * | 2/2000 | Sorkin | 403/374.1 |
| 6,234,709 | B1 * | 5/2001 | Sorkin | 403/374.1 |
| 6,513,287 | B1 * | 2/2003 | Sorkin | 52/223.13 |
| 7,614,134 | B2 * | 11/2009 | Messein et al. | 29/525 |
| 2002/0007604 | A1 * | 1/2002 | Wallstein | 52/223.13 |
| 2002/0083659 | A1 * | 7/2002 | Sorkin | 52/167.1 |

* cited by examiner

*Primary Examiner* — Robert Canfield
*Assistant Examiner* — Brent W Herring
(74) *Attorney, Agent, or Firm* — Egbert Law Offices PLLC

(57) ABSTRACT

A method for forming a sheathing retaining anchor of a post-tension anchor system includes the steps of: forming an anchor having a bore where the bore has a tapered portion and a constant diameter portion, inserting an end of a tendon through the bore of the anchor so that the end of the tendon extends outwardly of tapered portion of the bore of the anchor, positioning a sheathing lock on the end of the sheathed portion or a tendon, placing a pair of wedges on the unsheathed portion of the tendon, and moving the sheathing lock and the pair of wedges into the bore of the anchor so that the sheathing lock affixes the end of the sheathed portion within the bore and so that the pair of wedges affixes the unsheathed portion within the bore.

12 Claims, 6 Drawing Sheets

PROCESS AND APPARATUS FOR FORMING A SHEATHING RETAINING ANCHOR

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to post-tension anchor systems. More particularly, the present invention relates to anchors used in such systems. More particularly, the present invention relates to affixing a tendon within an anchor of such systems. Additionally, the present invention relates to affixing a sheathing of a tendon within an anchor of such systems.

2. Description of Related Art Including Information Disclosed Under 37 CFR 1.97 and 37 CFR 1.98

For many years, the design of concrete structures imitated the typical steel design of column, girder and beam. With technological advances in structural concrete, however, concrete design began to evolve. Concrete has the advantages of costing less than steel, of not requiring fireproofing, and of having plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced-concrete framing is seemingly a simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, comprising a mixture of water, cement, sand, and stone or aggregate and having proportions calculated to produce the required strength, is set, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as five hundred feet can be attained in members as deep as three feet for roof loads. The basic principle is simple. In pre-stressing, reinforcing rods of high tensile strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

In typical post-tension systems, the tendon is received between a pair of anchors. One of the anchors is known as the "live end" anchor, and the opposite end is known as the "dead-end" anchor. The "live end" anchor receives the end of the tendon which is to be tensioned. The "dead-end" anchor holds the tendon in place during the tensioning operation. Under typical operations, a plurality of wedges are inserted into an interior passageway of the anchor and around the exterior surface of the tendon. The tendon is then tensioned so as to draw the wedges inwardly into the interior passageway so as establish compressive and locking contact with an exterior surface of the tendon. This dead-end anchor can then be shipped, along with the tendon, for use at the job site.

One technique for forming such dead-end anchors is to insert the end of a tendon into the cavity of the anchor, inserting wedges into the space between the tendon and the wall of the cavity and then applying a tension force onto another end of the tendon so as to draw the wedges and the end of the tendon into the cavity in interference-fit relationship therewith. This procedure is somewhat difficult since the tendon can have a considerable length and since the use of tension forces can create a somewhat unreliable connection between the wedges and the tendon. Experimentation has found that the application of compressive force onto the end of the tendon creates a better interference-fit relationship between the wedges, the end of the tendon and the wall of the cavity of the anchor.

Various patents have addressed the creation of dead-end anchorages. For example, U.S. Pat. No. 6,513,287, issued on Feb. 4, 2003 to the present inventor, discloses a method and apparatus for forming an anchorage of a post-tension system in which a tendon is positioned within a cavity of an anchor such that an end of the tendon extends outwardly of the cavity, a plurality of wedges are mechanically inserted within the cavity between the tendon and a wall of the cavity, and pressure is applied to an end of the tendon such that the tendon and the wedges are in interference-fit relationship with the cavity. A compression mechanism is used having a cylindrical member and a plunger extending in a channel of the cylindrical member. The wedges are attached to the cylindrical member and the cylindrical member is moved toward the cavity such that the wedges enter a space between the tendon and the wall of the cavity. The plunger applies a compressive force to the end of the tendon when the end of the tendon is in the channel of the cylindrical member.

U.S. Pat. No. 5,755,065, issued on May 26, 1998 to the present inventor, discloses a post-tension system including an anchor member having a tendon-receiving interior passageway, a tendon extending through the passageway, a pair of wedges interposed between the anchor member and the tendon in the interior passageway, and a spring received by one end of the anchor member so as to be in compressive relationship with the pair of wedges so as to urge the pair of wedges in a direction toward an opposite end of the anchor member. A cap member is affixed to one end of the anchor member and extends over an end of the tendon. The spring is interposed between the cap and the plurality of wedges. The spring is affixed to an interior shoulder on the cap member. A seal is interposed between an exterior surface of a sheathed portion of the tendon and an interior surface of a tubular extension formed in an encapsulation around the anchor.

However, these methods do not address the formation of an anchor with a sheathing lock. Sheathing locks were invented so as to retain the sheathing of a tendon within the anchor so as to prevent the shrinkage of the sheathing while post-tensioning. The present inventor has filed various patent applications pertaining to different sheathing locks: U.S. patent application Ser. No. 11/861,185, filed on Sep. 25, 2007, entitled "Apparatus for Preventing Shrinking of a Sheathing Over a Tendon"; U.S. patent application Ser. No. 11/933,029, filed on Oct. 31, 2007, entitled "Shrinkage Preventing Device for the Sheathing if a Tendon"; U.S. patent application Ser. No. 11/933,041, filed on Oct. 31, 2007, entitled "Shrinkage Preventing Apparatus for the Sheathing of a Tendon"; U.S. patent application Ser. No. 11/950,295, filed on Dec. 4, 2007, entitled "Unitary Sheathing Wedge"; U.S. patent application Ser. No. 12/100,066, filed on Apr. 9, 2007, entitled "Sheathing Lock"; U.S. patent application Ser. No. 12/123,432, filed on May 19, 2008, entitled "Sheathing Retaining Clip; and U.S. patent application Ser. No. 12/133,947, filed on Jun. 5, 2008, entitled "Compression Cap Sheathing Lock." Because current methods for forming dead-end anchors do not address the use of sheathing locks, there is a need for a method for forming a sheathing retaining anchor.

It is an object of the present invention to provide a method for forming a sheathing retaining anchor that retains a tendon within an anchor.

It is another object of the present invention to provide a method for forming a sheathing retaining anchor that retains a sheathing of a tendon within an anchor.

It is another object of the present invention to provide a method for forming a sheathing retaining anchor in which the tendon in installed by compression forces.

It is another object of the present invention to provide a method which eliminates the hand positioning of wedges during such compression forming.

It is still another object of the present invention to provide a method for forming a sheathing retaining anchor which is safe, easy to use, and relatively inexpensive.

It is another object of the present invention to provide a method for forming a sheathing retaining anchor which eliminates any buckling of the end of the strand during compression fitting.

These and other objects and advantages of the present invention will become apparent from a reading of the attached specification and appended claims.

BRIEF SUMMARY OF THE INVENTION

The present invention is a method for forming a sheathing retaining anchor of a post-tension anchor system. The method includes the steps of forming an anchor having a bore where the bore has a tapered portion and a constant diameter portion, removing a portion of a sheathing from an end of a tendon so that the end of the tendon has a sheathed portion and an unsheathed portion, inserting the end of the tendon through the bore of the anchor so that the end of the tendon extends outwardly of the anchor, positioning a sheathing lock on the end of the sheathed portion, placing a pair of wedges on the unsheathed portion, moving the sheathing lock and the pair of wedges into the bore of the anchor so that the sheathing lock affixes the end of the sheathed portion within the bore and so that the pair of wedges affix the unsheathed portion within the bore, removing the anchor from the fixture, forming a compression mechanism that has a cylindrical member and a plunger interior of the cylindrical member, forming the sheathing lock so as to have a tubular body with a collar at one end thereof, and inserting the end of the tendon into the interior of the cylindrical member.

The step of positioning the sheathing lock includes placing the sheathing lock onto the sheathed portion such that the collar abuts the end of the sheathed portion. The step of positioning the pair of wedges includes placing the pair of wedges against an end of the cylindrical member such that the pair of wedges overlie the unsheathed portion. The step of moving includes applying pressure against the end of the tendon in axial alignment with the tendon. The step of forming a compression mechanism includes resiliently positioning the cylindrical member over the plunger. The step of forming the sheathing lock includes forming the tubular body of a polymeric material so that the tubular body has a split extending longitudinally along a length of the tubular body. The step of positioning the sheathing lock includes opening the tubular body along the split and urging the tubular body toward the sheathed portion such that the unsheathed portion enters an interior of the tubular body through the opened split. The tubular body has a plurality of ribs formed on an inner wall thereof. The tubular body is interposed between a wall of the bore against the sheathed portion such that the plurality of ribs engage the sheathed portion.

The present invention is an apparatus comprising a fixture, a compression mechanism mounted adjacent the fixture, an anchor removably mounted to the fixture, a tendon extending through a cavity of the anchor so as to have an unsheathed portion extending outwardly of an end of the anchor, a sheathing lock positioned over a sheathed portion of the tendon, a pair of wedges positioned over the unsheathed portion of the tendon, and an actuating means cooperative with the compression mechanism.

The compression mechanism has a cylindrical member and a plunger interior of the cylindrical member. The cavity is formed in an interior of the anchor. The actuating means urges the plunger toward the cavity of the anchor. The plunger is longitudinally axially aligned with the tendon. The pair of wedges reside against an end of the cylindrical member. The sheathing lock has a generally tubular body with a collar formed at one end thereof. The generally tubular body resides over the sheathed portion. The collar resides against an end of the sheathed portion. The cylindrical member is resiliently mounted over the plunger such that the cylindrical member is resiliently movable relative to the plunger. The cavity has a tapered portion and a constant diameter portion. The tapered portion has a wide end facing the compression mechanism. The tubular body has a plurality of ribs formed on an inner wall thereof. The tubular body has a split extending longitudinally along a length of the tubular body. The sheathing lock is formed entirely of a polymeric material.

DETAILED DESCRIPTION OF THE INVENTION

Figure 1:
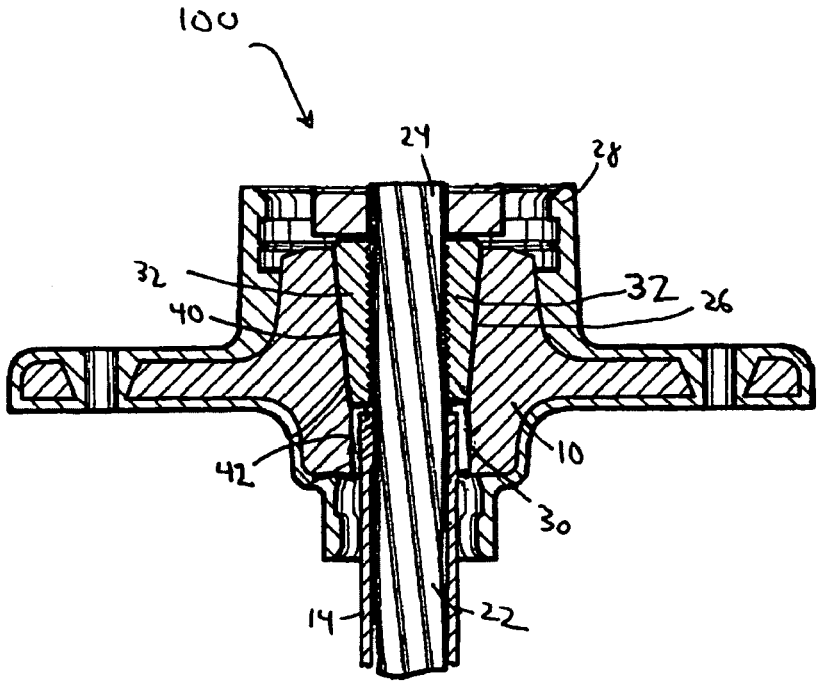
FIG. 1 shows a cross-sectional view of the sheathing retaining anchor formed according to the method of the present invention.

Referring to FIG. 1, there is shown a cross-sectional view of the sheathing retaining anchor 100 formed according to the preferred method of the present invention. The sheathing retaining anchor 100 has an anchor 10. The anchor 10 has a bore 26. The bore 26 has a tapered portion 40 and a constant diameter portion 42. A pair of wedges 32 affix the tendon 22 within the bore 26 of the anchor 10. The wedges 32 are positioned between a tapered portion 40 of the bore 26 and the tendon 22. A sheathing lock 30 affixes the sheathing 14 of the tendon 22 within the bore 26 of the anchor 10. The sheathing lock 30 is positioned between a constant diameter portion 42 of the bore 26 and the sheathing 14. An end 24 of the tendon 22 extends outwardly of the tapered portion 40 of the bore 26 at the end 28 of the anchor 10. The wedges 32 affix the tendon 22 within the bore 26 of the anchor 10. The sheathing lock 30 affixes the sheathing 14 of the tendon 22 within the bore 26 of the anchor 10. The sheathing lock 30 holds the sheathing 14 within the anchor 10 and resists shrinkage of the sheathing 14 away from the anchor 10 that typically occurs during installation of post-tensioning systems utilizing tendons and anchors. The method of the present invention affixes the tendon 22 and sheathing 14 within the anchor 10.

Figure 2:
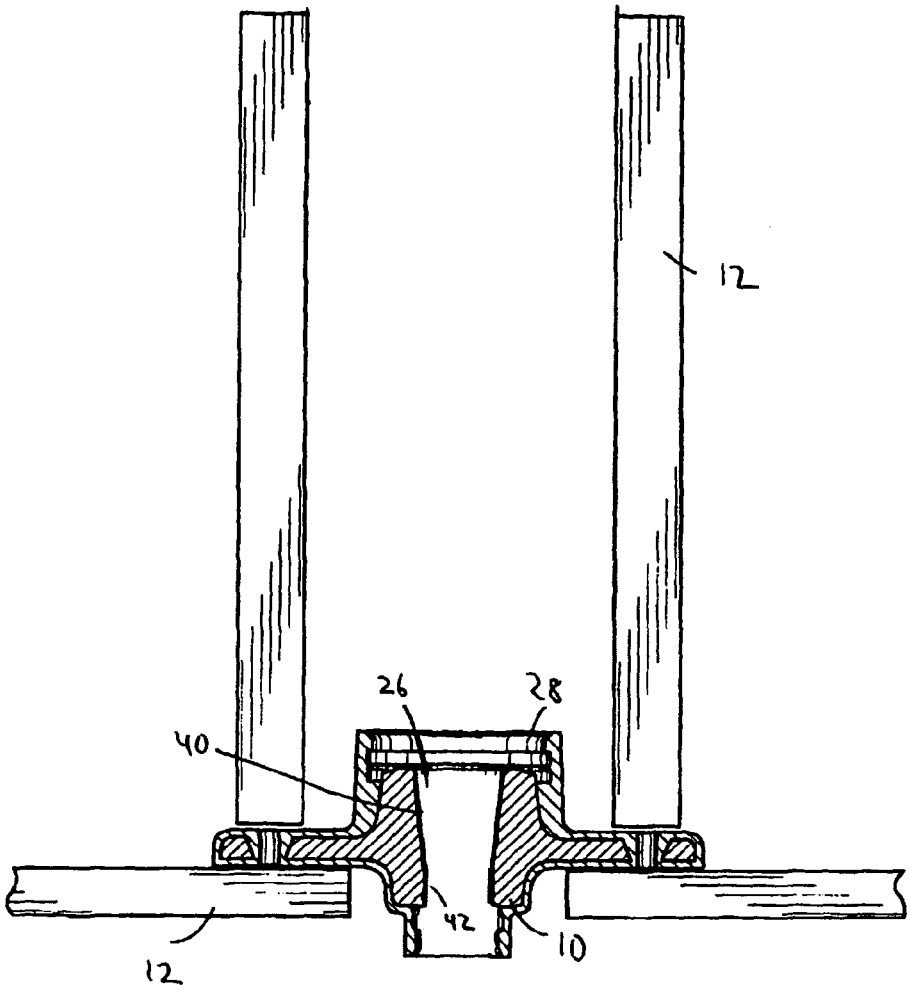
FIG. 2 shows a cross-sectional view of an anchor fixed in a fixture according to the preferred method of the present invention.

Referring to FIG. 2, there is shown a cross-sectional view of an anchor 10 fixed in a fixture 12 according to the preferred method of the present invention. The anchor 10 has a tapered bore 26 that has a tapered portion 40 and a constant diameter portion 42. The end 28 of the anchor 10 is located at the wide end of the bore 26. The fixture 12 is an apparatus that holds the anchor 10 in a stationary position. The bore 26 is made of a size suitable for placing a tendon having a sheathing therein.

Figure 3:
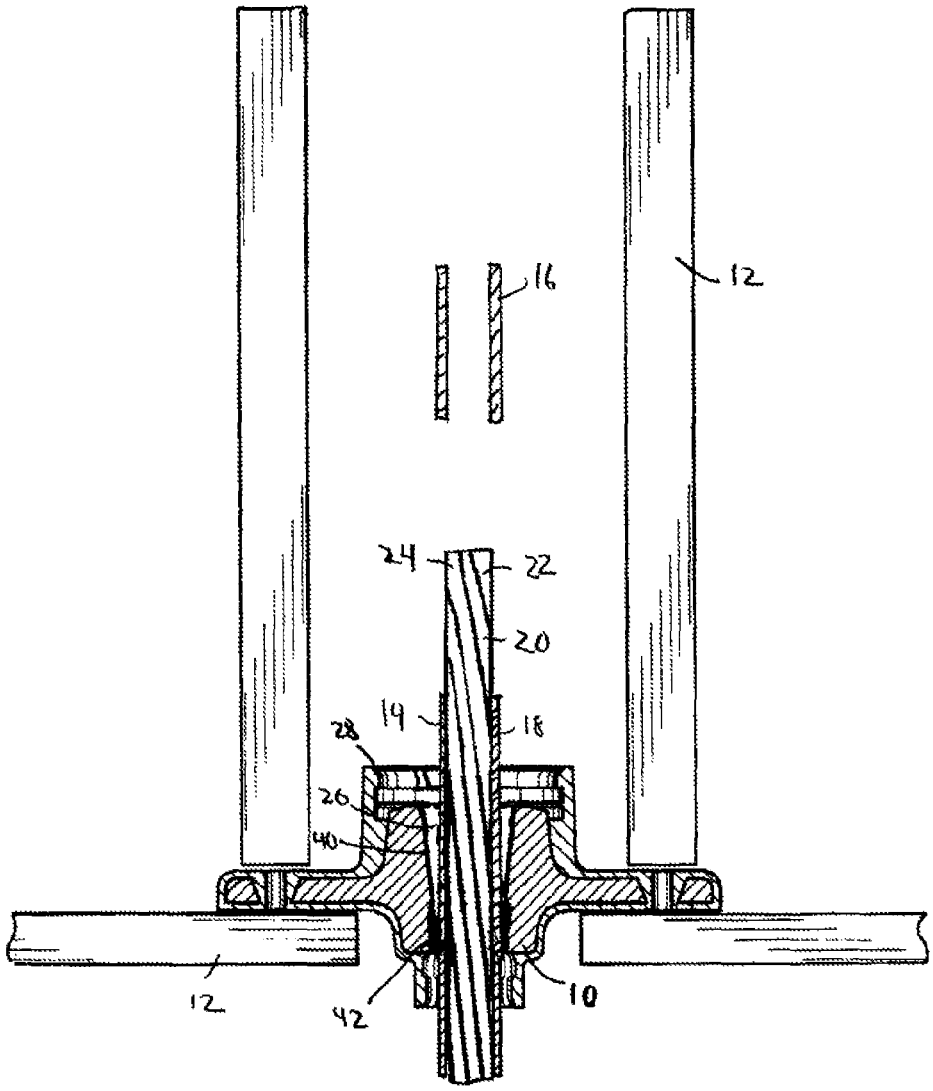
FIG. 3 shows a cross-sectional view of the fixed anchor with a tendon inserted therein according to the preferred method of the present invention.

Referring to FIG. 3, there is shown a cross-sectional view of the fixed anchor 10 with a tendon 22 inserted therein according to the preferred method of the present invention. The tendon 22 has a sheathing 14 extending therearound. The sheathing 14 and the tendon 22 extend freely through the bore 26 of the anchor 10. The tendon 22 is inserted through the constant diameter portion 42 before being inserted through the tapered portion 40 of the bore 26 of the anchor 10. As can be seen in FIG. 3, a portion 16 of the sheathing 14 has been removed from the end 24 of the tendon 22 so as to create an unsheathed portion 20 and a sheathed portion 18 of the tendon 22. The portion 16 is discarded and no longer used in the method of the present invention. Thus, a sheathed portion 18 and an unsheathed portion 20 extend outwardly of the end 28 of the anchor 10.

Figure 4:
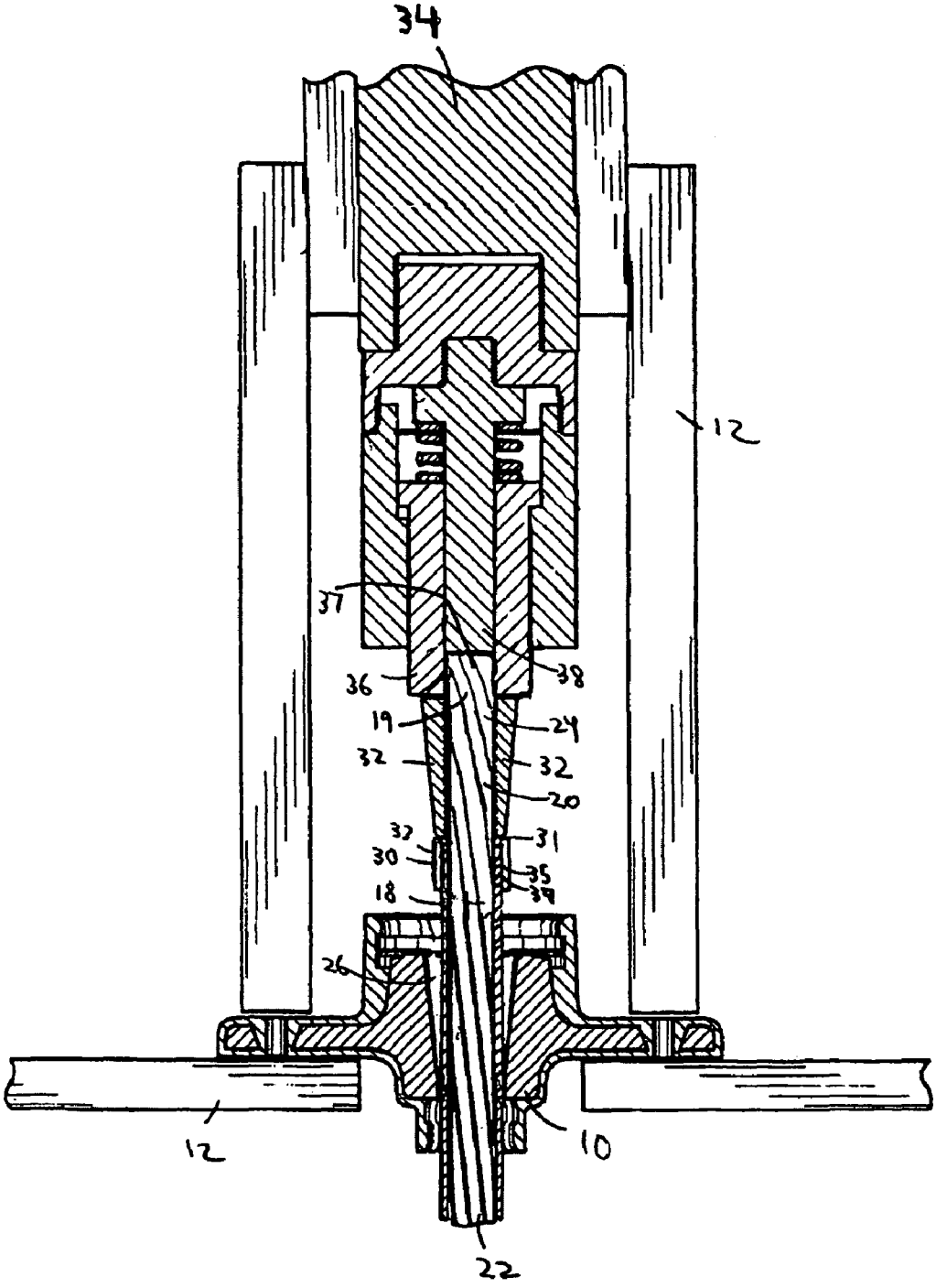
FIG. 4 shows a cross-sectional view of the anchor and tendon, with wedges and a sheathing lock placed on the tendon, and a compression mechanism positioned adjacent an end of the tendon according to the method of the present invention.

Referring to FIG. 4, there is shown a cross-sectional view of the anchor 10 and tendon 22, with wedges 32 and a sheathing lock 30 placed on the tendon 22, and a compression mechanism 34 positioned adjacent an end 24 of the tendon 22 according to the method of the present invention. The compression mechanism 34 has a cylindrical member 36 and a plunger 38 interior of the cylindrical member 36. The cylindrical member 36 is resiliently mounted over the plunger 38 such that the plunger 38 moves relative to the cylindrical member 36. The interior 37 of the compression mechanism 34 is placed over the end 24 of the tendon 22, which is also the end 21 of the unsheathed portion 20. The wedges 32 are placed around the end 21 of the unsheathed portion 20. The cylindrical member 36 of the compression mechanism 34 abuts the wedges 32. In the preferred embodiment of the present invention, the wedges 32 and the cylindrical member 36 are made of a magnetic metallic material, and the wedges 32 are held around the unsheathed portion 20 of the tendon 22 by a magnetic force provided by the cylindrical member 36 of the compression mechanism 34.

The sheathing lock 30 is placed around the end 19 of the sheathed portion 18 of the tendon 22. The sheathing lock 30 has a tubular body 33. The sheathing lock 30 has a collar 31 formed on an end thereof. When the sheathing lock 30 is placed on the sheathed portion 18, the collar 31 abuts the end 19 of the sheathed portion 18 and helps hold the sheathing lock 30 on the sheathing 14 of the sheathing portion 18. The collar 31 abuts the wedges 32. The collar 31 also serves to hold the sheathing lock 30 and wedges 32 in place around the sheathed portion 18 and unsheathed portion 20, respectively, while the compression mechanism 34 is actuated. The tubular body 33 has ribs 35 formed on an inner wall 39 thereof. The tubular body 33 is interposed between a wall of the bore 26 and the sheathed portion 18 so that the ribs 35 engage the sheathed portion 18. The tubular body 33 is formed of a polymeric material. The tubular body 33 has a split extending longitudinally along a length of the tubular body 33. The tubular body 33 is opened along the split so that the unsheathed portion 20 enters an interior of the tubular body 33 as the tubular body 33 is urged towards the sheathed portion 18.

Figure 5:
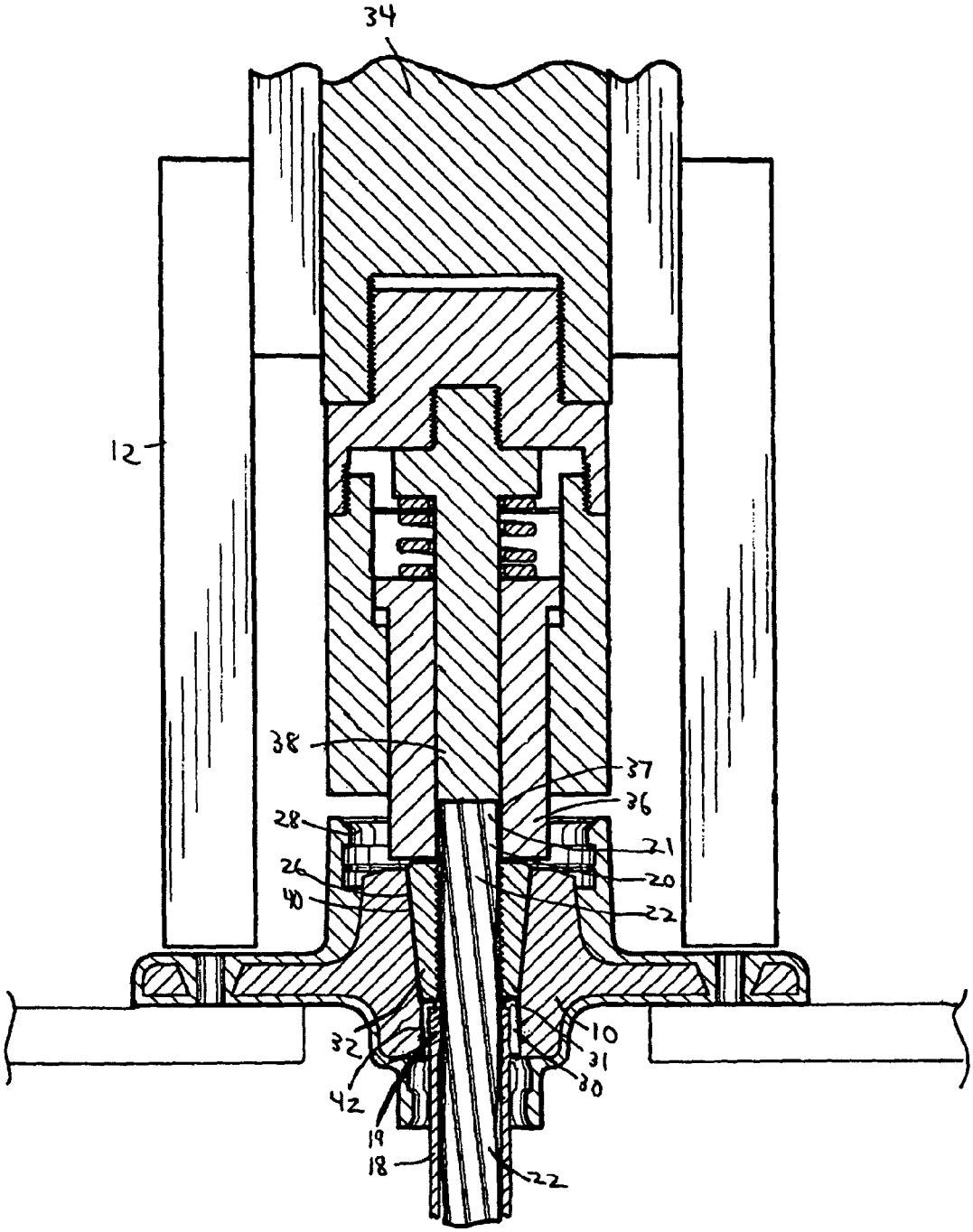
FIG. 5 shows a cross-sectional view of the fixed anchor, with the tendon, sheathing lock, and wedges moved into a bore of the anchor by the compression mechanism according to the method of the present invention.

The compression mechanism 34 is actuated against the end 21 of the unsheathed portion 20 so as to push the sheathing lock 30 placed around the sheathed portion 18 and the pair of wedges 32 placed around the unsheathed portion 20 into the bore 26 of the anchor 10. During actuation, the end 21 of the unsheathed portion 20 resides in the interior 37 of the cylindrical member 36. The cylindrical member 36 moves toward the anchor 10 until the cylindrical member 36 is adjacent the end 28 end of the anchor 10 (as is shown in FIG. 5). If needed, the plunger 38 of the compression mechanism 34 can move so as to push the end 21 of the unsheathed portion 20 toward the bore 26 of the anchor 10.

Referring to FIG. 5, there is shown a cross-sectional view of the fixed anchor 10, with the tendon 22, sheathing lock 30, and wedges 32 moved into the bore 26 of the anchor 10 by the compression mechanism 34. As can be seen, the cylindrical member 36 and plunger 38 of the compression mechanism 34 are adjacent the end 28 of the anchor 10. The end 21 of the unsheathed portion 20 still resides 37 within the interior 37 of the cylindrical member 36, but the plunger 38 can be activated, if needed, to move the end 21 of the unsheathed portion 20 toward the tapered portion 40 of the bore 26 of the anchor 10. The wedges 32 affix the tendon 22 within the tapered portion 40 of the bore 26 of the anchor 10. The sheathing lock 30 affixes the sheathing 14 of the end 19 of the sheathed portion 18 in the constant diameter portion 42 of the bore 26 of the anchor 10. The collar 31 of the sheathing lock 30 is adjacent the wedges 32 within the bore 26 of the anchor 10.

Figure 6:
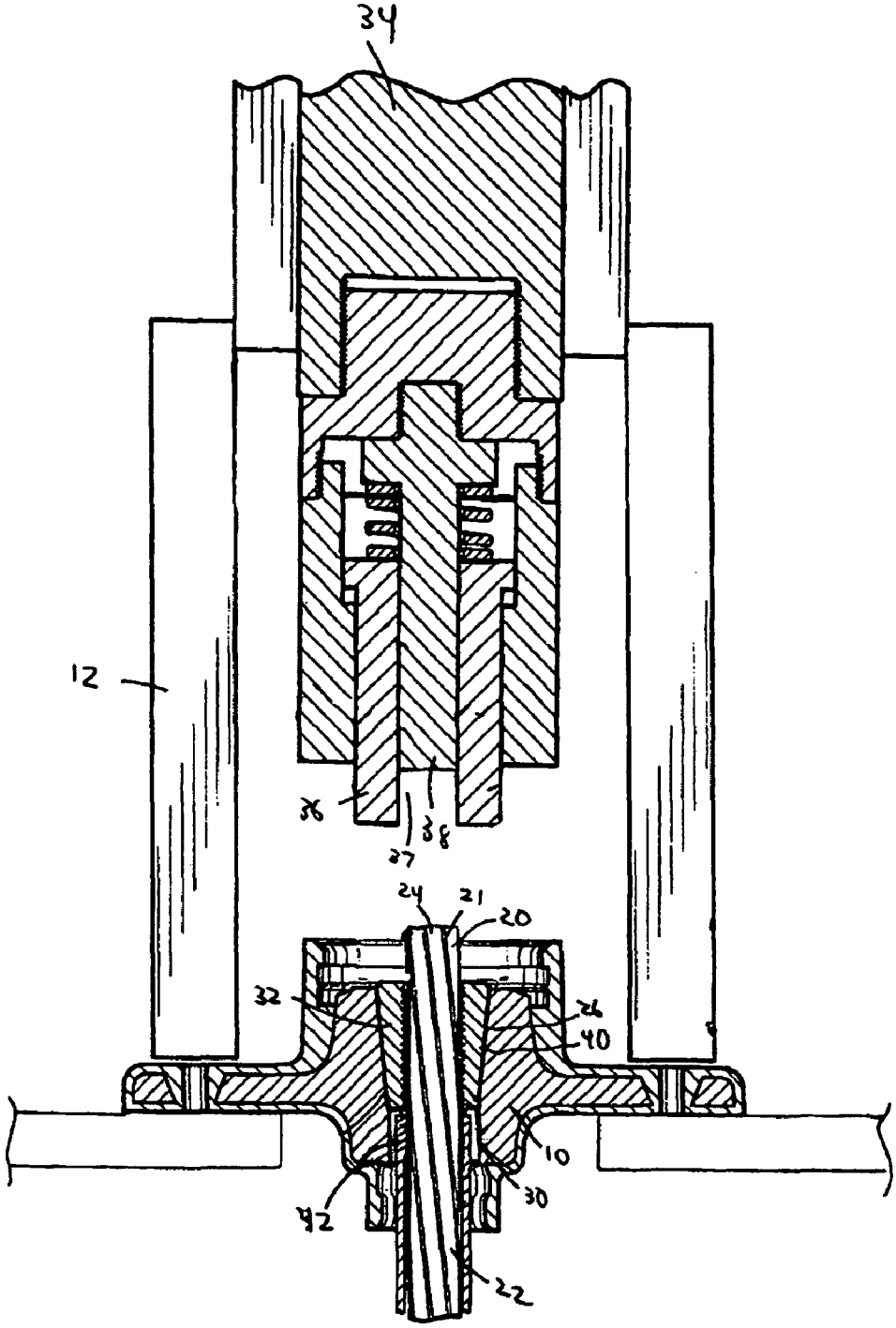
FIG. 6 shows a cross-sectional view of the anchor with wedges and sheathing lock affixed to the tendon and sheathing, respectively, therein.

Referring to FIG. 6, there is shown a cross-sectional view of the anchor 10 with the wedges 32 and sheathing lock 30 affixed to the tendon 22 and sheathing 14, respectively, therein. The cylindrical member 36 and plunger 38 of the compression mechanism 34 have been retracted from the end 21 of the unsheathed portion 20 of the tendon 22. The plunger 38 retracts into the interior 37 of the cylindrical member 36. The wedges 32 reside between the tapered portion 40 of the bore 26 of the anchor 10. The sheathing lock 30 resides between the constant diameter portion 42 of the bore 26 of the anchor 10.

In FIGS. 4-6, it can be seen that the compression mechanism 34 is guided along the longitudinal axis of the bore 26 of the anchor 10 by the fixture 12. This prevents any multi-directional movement of the compression mechanism 34 and the anchor 10 while executing the method of the present invention.

After affixing the tendon 22 and sheathing 14 within the bore 26 of the anchor 10, the anchor 10 is removed from the fixture 12 so as to produce a sheathing retaining anchor 100 as shown in FIG. 1. Using a sheathing lock 30 with an anchor 10 is the simplest way yet to seal an end of the anchor 10 from moisture and other environmental contaminants that could cause corrosion in the bore 26 of the anchor 10 and to the tendon 22. The sheathing lock 30 effectively retains the sheathing 14 of the tendon 22 within the bore 26 of the anchor. This retention prevents the sheathing 14 from shrinking away from the anchor 10 so as to expose the tendon 22 to moisture and other corrosion-causing contaminants. Moreover, when the sheathing 14 shrinks away from the anchor 10, the bore 26 of the anchor 10 is susceptible to corrosion. The sheathing lock 30 seals the sheathing 14 in the bore 26 of the anchor 10 and avoids the use of corrosion-protection tubes placed on the end of the anchor 10, thus lowering the cost of manufacturing and installing of such anchors 10.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A method for forming a sheathing retaining anchor of a post-tension anchor system comprising:

fixing an anchor in a fixture;

removing a portion of a sheathing from an end of a tendon so that said end of said tendon has an unsheathed portion, said sheathing having an end adjacent said unsheathed portion;

inserting said end of said tendon through a bore of said anchor so that said unsheathed portion of said end of said tendon extends outwardly of an end of said anchor, said end of said sheathing being positioned outwardly of the same end of said anchor, said bore having a tapered portion and a constant diameter portion;

positioning a sheathing lock on said end of said sheathing such that said sheathing lock overlies said sheathing;

placing a pair of wedges on said unsheathed portion; and compressively pushing said sheathing lock and said pair of wedges into said bore of said anchor so that said sheathing lock is interposed between said constant diameter portion of said bore and said end of said sheathing so as to affix said end of said sheathing within said bore and such that said pair of wedges are interposed between said tapered portion of said bore and said unsheathed portion of said tendon so as to affix said unsheathed portion within said bore.

2. The method of claim 1, further comprising:

removing said anchor from said fixture.

3. The method of claim 1, further comprising:

forming a compression mechanism having a cylindrical member and a plunger interior of said cylindrical member.

4. The method of claim 3, said step of compressively urging comprising:

actuating said compression mechanism against an end of said unsheathed portion so as to push said sheathing lock and said pair of wedges into said bore of said anchor; and retracting said compression mechanism after said sheathing lock affixes said end of said sheathing portion within said bore and after said pair of wedges affixes said unsheathed portion within said bore.

5. The method of claim 4, said end of said unsheathed portion residing in an interior of said cylindrical member prior to the step of actuating.

6. The method of claim 5, said step of actuating comprising:

moving said cylindrical member toward said anchor until said cylindrical member is adjacent an end of said anchor; and moving said plunger so as to push said end of said unsheathed portion toward said bore of said anchor.

7. The method of claim 6, the step of moving comprising:

applying pressure against said end of said tendon in axial alignment with said tendon.

8. The method of claim 3, further comprising:

inserting said end of said tendon into the interior of said cylindrical member, the step of placing said pair of wedges comprising placing said pair of wedges against an end of said cylindrical member such that said pair of wedges overlie said unsheathed portion.

9. The method of claim 3, the step of forming a compression mechanism comprising:

resiliently positioning said cylindrical member over said plunger.

10. The method of claim 1, further comprising:

forming said sheathing lock having a generally tubular body with a collar at one end thereof, the step of positioning the sheathing lock comprising placing said sheathing lock onto said such that said collar abuts said end of said sheathing.

11. The method of claim 10, said tubular body having a plurality of ribs formed on an inner wall thereof, the method further comprising:

interposing said tubular body between a wall of said constant diameter portion of said bore and against said sheathing such that said plurality of ribs engage said sheathing.

12. The method of claim 10, the step of forming said sheathing lock comprising:

forming said tubular body of a polymeric material, said tubular body having a split extending longitudinally along a length of said tubular body, the step of positioning said sheathing lock comprising opening said tubular body along said split and urging said tubular body toward said sheathing such that said sheathing enters an interior of said tubular body through the opened split.

* * * * *